US005170641A

United States Patent [19]

DiDomenico

[11] Patent Number: 5,170,641

[45] Date of Patent: Dec. 15, 1992

[54] PIN ADAPTOR FOR PIERCED EARRINGS

[76] Inventor: Joseph DiDomenico, 575 Mount Pleasant Ave., Providence, R.I. 02908

[21] Appl. No.: 883,298

[22] Filed: May 14, 1992

[51] Int. Cl.[5] ..... A44C 13/00

[52] U.S. Cl. ..... 63/1.1; 63/12; 63/20

[58] Field of Search ..... 63/1.1, 12, 14.1, 20

[56] References Cited

U.S. PATENT DOCUMENTS

| | | | |
|---|---|---|---|
| 1,515,313 | 11/1924 | Pejchar | 63/20 |
| 2,548,140 | 4/1951 | Bohlinger | 63/1.1 |
| 2,930,209 | 3/1960 | Altman | 63/1.1 |
| 3,122,007 | 2/1964 | Morland | 63/1.1 |
| 4,574,595 | 3/1986 | Moody . | |
| 4,653,292 | 3/1987 | Maupin et al. | 63/12 |
| 4,655,055 | 4/1987 | Moody . | |
| 4,840,045 | 6/1989 | Moody . | |
| 5,048,311 | 9/1991 | Mastrobuono . | |

*Primary Examiner*—Richard E. Moore
*Assistant Examiner*—Michael J. Milano
*Attorney, Agent, or Firm*—Salter, Michaelson & Benson

[57] ABSTRACT

An adaptor enables a pierced earring to be converted into a pin that may be worn on an article of clothing. The adaptor consists of a receptacle having a longitudinal bore which is adapted to receive the earring's post. For conversion, the earring post is bent downwardly and slidably inserted into the bore. A U-shaped flange is secured to the receptacle and extends above the upper edge thereof. The flange has a front portion which includes a notch in its upper edge for receiving the bent-over earring post so that when the post is fully inserted into the receptacle the notch prevents the earring from rotating. The flange further has a rear portion which includes a rearwardly extending pin. The pin is adapted to penetrate an article of clothing.

4 Claims, 1 Drawing Sheet

PIN ADAPTOR FOR PIERCED EARRINGS

BACKGROUND OF THE INVENTION:

The instant invention relates generally to jewelry and more specifically relates to an adaptor for converting a pierced earring into a pin that may be worn on a person's apparel.

Heretofore, it has been known in the jewelry art to provide a single decorative ornament with a plurality of mounting elements so that the ornament can be worn in a variety of different applications, such as in a pin or in a necklace. For example, the U.S. Pat. No. 5,048,311 to Mastrobuono discloses such a convertible jewelry article which comprises an ornamental member having a mounting bracket on the rear side thereof. A plurality of mounting elements adapted to attach to the mounting bracket are provided so that the ornamental member is convertible for use as an earring, a bar pin, or a necklace assembly.

It has also been known in the jewelry art to convert a pierced earring into other types of jewelry such as a pressure clip earring, or a lapel pin. In this regard the U.S. Pat. Nos. to Moody Nos. 4,655,055, 4,574,595 and 4,840,045 disclose jewelry mounting constructions for converting pierced earrings into pressure clip earrings to be worn on unpierced ears. The disclosed jewelry mountings comprise a receptacle which is adapted to receive the post of a pierced earring, and a spring clamp which is secured to the receptacle and is adapted to secure the wearer's earlobe between the receptacle and the clamp. The Moody patents also disclose a mounting construction for converting a pierced earring into a lapel pin. The lapel mounting construction comprises an elongated tubular receptacle, one end of which receives the post of the pierced earring and the other end receiving a tapered pin. Still further, the Moody patent No. 4,840,045 discloses a jewelry construction for converting a pierced earring into a pin or brooch of the safety-pin type. In the pin mounting, the pierced earring post is received in a receptacle which carries a pin adapted to be attached to the wearer's clothing.

SUMMARY OF THE INVENTION

The instant invention provides an adaptor which enables a pierced earring to be converted into a pin that may be worn on an article of clothing. Briefly, the adaptor comprises a receptacle having a longitudinal bore which is adapted to slidably receive the post of a pierced earring, and a U-shaped flange which is secured to the receptacle. A front portion of the flange includes a notch in the upper edge thereof, and a rear portion of the flange includes a rearwardly extending pin which is adapted for penetrating an article of clothing. For conversion of the earring, the earring post is bent downwardly, and slidably inserted into the bore. The notch in the front portion of the flange is adapted for receiving the bent-over earring post, so that when the post is fully inserted into the receptacle the earring is prevented from rotating.

Accordingly, it is an object of the instant invention to provide an adaptor for converting a pierced earring into a pin that may be worn on an article of clothing.

It is another object to provide a pin adaptor for pierced earrings which prevents the earring from rotating when it is assembled with the adaptor.

It is yet another object to provide a pin adaptor for pierced earrings which is simple in construction and easy to assemble with a pierced earring.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
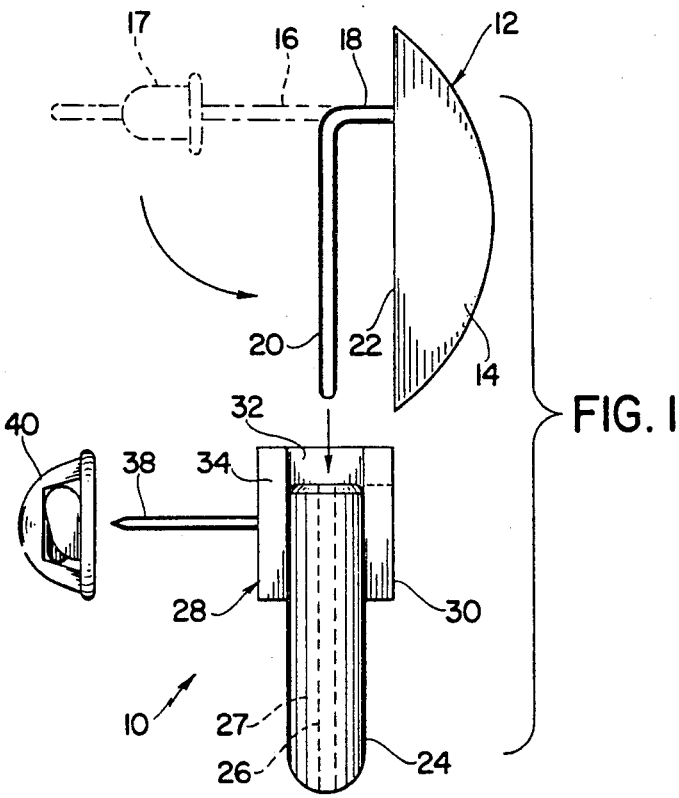
FIG. 1 is an exploded side view showing the pierced earring, the adaptor, and the clutch member which make up the instant invention.
Figure 2:
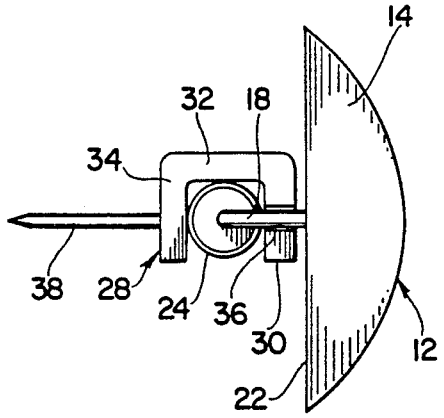
FIG. 2 is a top view of the assembled earring and adaptor.
Figure 3:
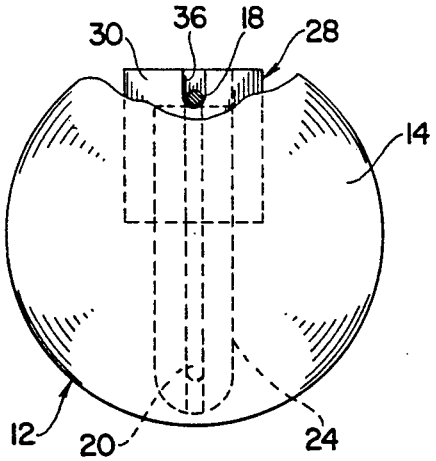
FIG. 3 is a partially fragmented front view of the assembly of FIG. 2.
Figure 4:
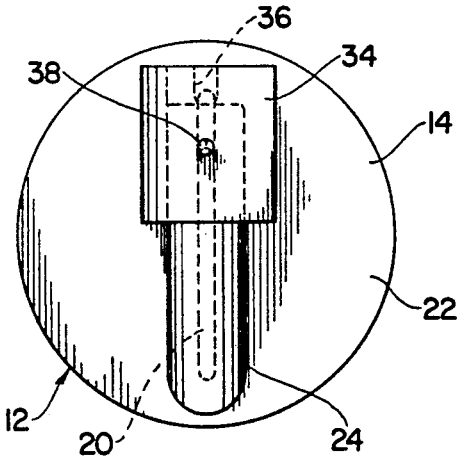
FIG. 4 is a rear view thereof.

Referring now to the drawings and particularly to FIG. 1, the pierced earring adaptor of the instant invention is illustrated and is generally indicated at 10. The adaptor 10 enables a pierced earring, generally indicated at 12, to be converted into a pin that may be worn on an article of clothing. The earring 12 comprises a decorative ornament 14, a rearwardly extending post 16 (shown in broken lines), and a clutch member 17, such as a conventional "bullet" clutch. For assembly with the adaptor 10, the clutch member 17 is removed and the post 16 is bent downwardly, so that there is a rearwardly extending portion 18 and a downwardly extending portion 20 which is positioned in slightly outwardly spaced relation to the rear side 22 of the ornament 14. The adaptor 10 comprises a receptacle 24 having a longitudinal bore 26 preferably lined with a friction lining 27 of polyethylene or the like, which is adapted for slidably and frictionally receiving the downwardly extending portion 20 of the earring post 16, and a U-shaped flange generally indicated at 28 (FIGS. 1 and 2) which has a front portion 30, a side portion 32, and a rear portion 34. The flange 28 is secured adjacent the upper end of the receptacle 24 by any suitable means, such as an epoxy type glue or the like, so that an upper edge portion of the flange 28 extends upwardly above the top of the receptacle. The front portion 30 of the flange 28 includes a notch 36 at the top edge thereof which is adapted for receiving the rearwardly extending portion 18 of the post 16, so that when the post 16 is fully inserted into the receptacle 24 the ornament 14 is prevented from rotating. The rear portion 34 of the flange 28 has secured thereto a rearwardly extending pin 38 which is adapted for penetrating an article of clothing. The receptacle 24 and the flange 28 are preferably fashioned from a lightweight plastic material but may alternatively be fashioned from any suitable material, such as metal.

For assembly of the earring 12 and the adaptor 10, the post 16 of the earring 12 is bent downwardly as previously described, and slidably inserted into the bore 26 so that the rearwardly extending portion 18 of the post 16 is received within the notch 36 in the front portion 30 of the flange 28. It is pointed out that the post 16 is received in the bore 26 in a friction fit so that the post 16 can be easily removed from the receptacle 24, thereby allowing the adaptor 10 to be utilized with a plurality of different earrings. For attachment of the adaptor 10 to an article of clothing the pin 38 is pushed through the desired article of clothing and a friction or clutch member 40, such as a conventional "butterfly" clutch, is affixed onto the pin 38 to maintain the assembly in position.

It is seen therefore that the instant invention provides an effective adaptor 10 for converting a pierced earring 12 into pin that may be worn on an article of clothing. The pin adaptor 10 includes a unique notch 36 which prevents the earring 12 from rotating when the post 16 is received in the receptacle 24 of the adaptor. Further, the pin adaptor 10 is simple in structure and easy to assemble with a pierced earring 12. The only modification of the earring 12 which is required is to bend the post 16 of the earring downwardly. Thereafter, the post 16 of the earring is easily inserted into the receptacle 24 of the adaptor. For these reasons it is believed that the pierced earring adaptor of the instant invention represents significant advancements in the art which have substantial commercial merit.

Other objects, features and advantages of the invention shall become apparent as the description thereof proceeds when considered in connection with the accompanying illustrative drawings.

What is claimed is:

1. An adaptor for converting a pierced earring into a pin comprising:

a receptacle having a bore which is adapted for slidably and frictionally receiving a post of said earring, said earring post being bent downwardly for insertion into said bore;

a front flange secured to a forwardly disposed surface of said receptacle and extending above the top edge thereof, said front flange having a notch at its upper edge for receiving said downwardly bent earring post such that when said post is fully inserted into said receptacle, said notch prevents said earring from rotating; and a rear flange secured to a rearwardly disposed surface of said receptacle, said rear flange including a rearwardly extending pin that is adapted to penetrate an article of clothing.

2. In the adaptor of claim 1, said earring post being bent downwardly such that there is a rearwardly extending portion and a downwardly extending portion, said downwardly extending portion being slidably and frictionally received in said bore, and said rearwardly extending portion being received in said notch.

3. An adaptor for converting a pierced earring into a pin comprising:

a receptacle having a bore which is adapted for slidably and frictionally receiving a post of said earring, said earring post being bent downwardly for insertion into said bore; and a U-shaped flange secured to said receptacle and extending above the top edge thereof, said flange having a front portion including a notch at its upper edge for receiving said downwardly bent earring post such that when said post is fully inserted into said receptacle said notch prevents said earring from rotating, said flange further having a rear portion including a rearwardly extending pin that is adapted to penetrate an article of clothing.

4. In the adaptor of claim 3, said earring post being bent downwardly such that there is a rearwardly extending portion and a downwardly extending portion, said downwardly extending portion being slidably and frictionally received in said bore, and said rearwardly extending portion being received in said notch.

* * * * *